US007137214B2

(12) United States Patent
Hoerle et al.

(10) Patent No.: US 7,137,214 B2
(45) Date of Patent: Nov. 21, 2006

(54) SNOW REMOVAL MACHINE WITH SYSTEM FOR APPLYING A SURFACE TREATMENT MATERIAL

(75) Inventors: Michael Hoerle, Eden Prairie, MN (US); Elizabeth Earley, North Olmsted, OH (US); Lawrence Micek, Woodbury, MN (US); James Schmitz, Waconia, MN (US)

(73) Assignee: Cargill, Inc., Wayzata, MN (US)

( * ) Notice: Subject to any disclaimer, the term of this patent is extended or adjusted under 35 U.S.C. 154(b) by 0 days.

(21) Appl. No.: 10/404,070

(22) Filed: Apr. 2, 2003

(65) Prior Publication Data

US 2004/0194353 A1 Oct. 7, 2004

(51) Int. Cl.
*E01H 5/04* (2006.01)

(52) U.S. Cl. ..... 37/242; 239/663; 37/244; 37/227

(58) Field of Classification Search ..... 37/219, 37/227

See application file for complete search history.

(56) References Cited

U.S. PATENT DOCUMENTS

| | | | | | |
|---|---|---|---|---|---|
| 2,893,377 | A * | 7/1959 | Janousek | 126/343.5 R |
| 2,997,796 | A * | 8/1961 | Pogue et al. | 37/230 |
| 3,160,964 | A * | 12/1964 | Boyer et al. | 37/241 |
| 3,346,973 | A * | 10/1967 | Meyer | 37/227 |
| 3,410,262 | A * | 11/1968 | Qualls | 126/271.2 R |
| 3,456,368 | A * | 7/1969 | Jaques | 37/228 |
| 3,475,056 | A * | 10/1969 | Jones | 299/24 |
| 3,484,961 | A * | 12/1969 | Coslowsky | 37/227 |
| 3,964,183 | A * | 6/1976 | Mouat | 37/197 |
| 4,390,286 | A | 6/1983 | Regaldo | |
| 5,199,196 | A * | 4/1993 | Straley | 37/442 |
| 5,350,533 | A * | 9/1994 | Hubred et al. | 252/70 |
| 5,410,824 | A * | 5/1995 | Pedersen | 37/242 |
| 5,499,462 | A * | 3/1996 | Forsdahl et al. | 37/227 |
| 5,515,623 | A * | 5/1996 | Weeks | 37/227 |
| 5,588,231 | A * | 12/1996 | Mavrianos | 37/227 |
| 5,797,203 | A * | 8/1998 | Vanderlinden | 37/227 |
| 5,867,926 | A * | 2/1999 | Schmitt | 37/227 |
| 5,904,296 | A * | 5/1999 | Doherty et al. | 239/61 |
| 6,173,904 | B1 * | 1/2001 | Doherty et al. | 239/1 |
| 6,270,020 | B1 * | 8/2001 | Thompson et al. | 239/67 |
| 6,305,105 | B1 * | 10/2001 | Lowman | 37/228 |
| 6,353,212 | B1 * | 3/2002 | Smith | 219/533 |
| 6,446,879 | B1 * | 9/2002 | Kime | 239/7 |
| 6,508,018 | B1 | 1/2003 | O'Brien | |

FOREIGN PATENT DOCUMENTS

| | | |
|---|---|---|
| CH | 516050 | 11/1971 |
| EP | 0194 565 | 9/1986 |
| FR | 1602041 | 9/1970 |
| FR | 2071304 A | 9/1971 |
| WO | WO 01/14497 A1 | 3/2001 |

* cited by examiner

OTHER PUBLICATIONS

Search Report, European Application 04251921.5-1255 dated Jun. 22, 2005.

*Primary Examiner*—Victor Batson
(74) *Attorney, Agent, or Firm*—Banner & Witcoff, Ltd.

(57) ABSTRACT

A snow removal machine including a housing with a forward opening through which snow enters the snow removal machine. At least one rotatable member is positioned and rotatably secured within the housing for engaging and eliminating the snow from within said housing. The snow removal machine also includes a surface treatment application system with a treatment material dispensing system connected to the housing for dispensing a liquid or solid deicer and/or anti-icing treatment material over an area from which snow has been removed.

68 Claims, 9 Drawing Sheets

SNOW REMOVAL MACHINE WITH SYSTEM FOR APPLYING A SURFACE TREATMENT MATERIAL

FIELD OF THE INVENTION

Aspects of the present invention relate to a machine that removes snow and ice from a surface and treats the surface from which the snow has been removed. More specifically, aspects of the present invention relate to a machine with a rotating member that removes snow and ice from a surface. The machine then applies a deicer and/or anti-icing material to that surface to accelerate the melting of ice covering the surface and impede any future accumulation of snow and ice on that surface.

BACKGROUND OF THE INVENTION

As is well known, after snow falls it is desirable to remove the snow from areas that are used by pedestrians and vehicles. As used herein, the term "areas" includes sidewalks and other known pedestrian walkways such as walking paths, stairs, patios and decks, as well as driveways and certain roadways, parking areas and alleyways that are cleaned after a snowstorm with a conventional shovel, snowblower, or other equipment that carries a plow.

Larger conventional snow removal machines, such as snowblowers, can be mounted to the front of wheeled vehicles such as tractors. In these instances, a driver sits on the vehicle and drives the attached snowblower during its operation. Other conventional snow removal machines are walk-behind models that are self-propelled or manually pushed by the operator. Self-propelled models typically include a belt drive power transmission system having a driving pulley connected to the output shaft of an engine, a driven pulley connected to one end of a rotating shaft, and an endless belt positioned around the driving and driven pulleys for transmitting power from the engine to the rotating shaft, so that the wheels of the snowblower rotate in response to the operation of the engine when the transmission system is engaged. Examples of conventional snow removing machines are disclosed in U.S. Pat. No. 6,508,018, U.S. Pat. No. 6,499,237, U.S. Pat. No. 5,479,730, and U.S. Pat. No. 4,104,812, all of which are incorporated herein by reference.

Two major types of snow blowing systems are used in snowblowers. These systems include one-stage blower systems and two-stage blower systems. A one-stage snowblower usually has a housing including a sub-housing. The sub-housing has a front opening where the snow is taken in between spaced apart sidewalls, as a powered rotating member, such as an impeller or brush, cuts or sweeps the snow. An engine is mounted on the housing and the impeller is journalled into the sidewalls of the sub-housing. The impeller is rotated by a direct drive mechanism connected to the engine as is known. In a one-stage snowblower, the impeller is the only powered device used for collecting the snow and throwing the snow out the snowblower's snow exhaust chute or front opening.

A two-stage snowblower is similar to a one-stage snowblower in that it has a main housing with a front sub-housing having spaced apart sidewalls and an engine mounted to the main housing. However, a two-stage snowblower uses an auger journalled between the spaced apart sidewalls of the sub-housing to collect the snow to be brought into an opening of the sub-housing. The auger is generally a pair of opposing helical members that in a first stage rotate to force the snow into the opening of the sub-housing. In the second stage, a fan is located to the rear of the opening. The fan forces the snow up and out of the snow exhaust chute as the fan rotates.

In the typical operation of a snowblower, a scrapper at the front of the sub-housing opening lifts the snow into the sub-housing where the rotating auger(s) or impeller cuts the snow. However, no matter the type of conventional snowblower used to clear an area, after the snowblower passes over the area, a layer of snow, ice and/or slush will remain. This can be due to the inability of the snowblower to scrape all of the snow, ice and/or slush off the surface of the area because of damage to the opening of the sub-housing. This can also be caused by an irregular/uneven surface in the area being snowblown that results in the front opening of the snowblower riding over the highest point of the irregular/uneven surface and thereby passing over some of the snow, ice and/or slush. No matter the cause of the leftover snow, ice and/or slush, the mere fact that it remains after the snowblower has gone over the area can create a very dangerous situation for people traversing the area, especially if the remaining snow and slush freeze and turn to ice. In order to treat this situation, many people attempt to spread a deicer on the surface of the area using their hand or a manual spreader after they have completed using their snowblower. However, these spreaders may not provide enough deicer to effect a substantially complete clearing of the path. Alternatively, an excessive amount of the deicer may be applied over the area to be treated. Excessive amounts of deicer can cause significant waste of the deicer and structural damage to the surface of the area that will only add to the inability of a snowblower to effectively clean off that area in the future. Additionally, excessive amounts of deicer can be environmentally dangerous and cause injuries to people and animals that use the treated area. As a result, a system for properly applying a predetermined and accurate amount of a treatment material is needed.

Moreover, modern society places a premium on the time that people have to complete occupational tasks as well as house and yard work. As a result, the additional steps of having to separately retrieve and distribute deicing and/or anti-icing agents is undesirable as it adds to the total time required to complete the snow removal and treat the area from which the snow was removed.

A need therefore exists in the art for a snow removal device that applies a treatment material to the surface of an area after a snowblower has passed over that surface in order to deice the surface and prevent the formation of future ice and snow on the surface. A need also exists for such a device that eliminates the additional steps of retrieving the deicing and/or anti-icing material and applying it separately from the snow removal operation.

SUMMARY OF THE INVENTION

An aspect of the present invention relates to an improved snow removal machine that includes a surface treatment material application system. This system allows for the application of deicing and/or anti-icing liquids or solids, or the combination of liquids and solids, to surfaces after they have been mechanically cleared with a snow removal machine. After surfaces have been mechanically cleared of snow, there is often a hard layer of snow/ice left behind that the snow removal machine has not removed. The application of a liquid and/or solid deicer will remove this residual snow and ice chemically. The application of a liquid or solid anti-icing agent in combination with a liquid or solid deicer minimizes the adherence of future snow and ice to the surfaces, thereby allowing the snow removal machine to be more effective in its subsequent uses. Additionally, aspects of the present invention save time and cost by allowing the deicer and/or anti-icing material to be applied at the same time that snow is being removed from a surface.

One aspect of the present invention includes a snow removal machine comprising a housing including a forward opening through which snow enters the machine, and an area for receiving the snow that entered through the opening. The machine also includes at least one rotatable member positioned within the snow receiving area for engaging and eliminating the snow within the housing. The machine further includes a surface treatment application system that has a dispenser connected to the housing for dispensing a deicer and/or an anti-icing material.

Another aspect of the present invention includes a machine for removing snow from a surface. The machine comprises a housing including at least one rotating member for engaging snow received within the housing and throwing the snow from within the housing. The machine also includes a surface treatment material application system associated with the housing for applying a deicer and/or an anti-icing material to a surface to be treated.

A further aspect of the present invention relates to a device containing a deicer and/or anti-icing material for attachment to a snowblower.

DETAILED DESCRIPTION OF THE INVENTION

Figure 1:
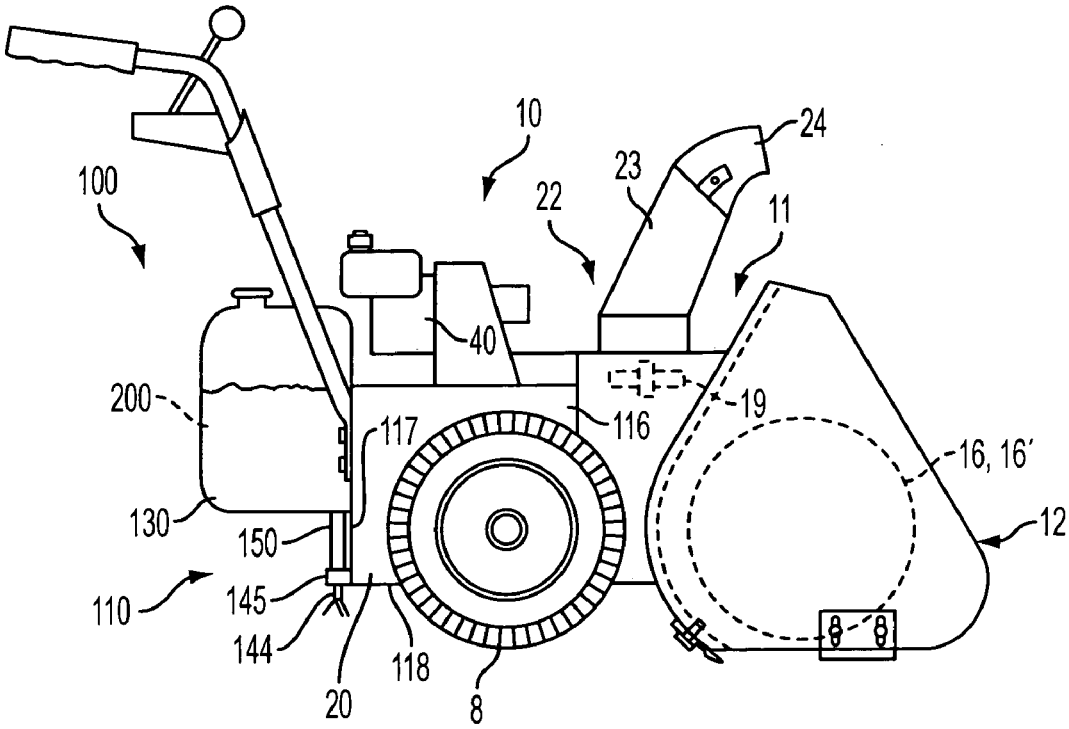
FIG. 1 illustrates a snow removal machine according to an aspect of the present invention including a system for dispensing a surface treatment material.

FIG. 1 illustrates a machine 10 according to aspects of the present invention for removing snow from an area. The machine 10 can include a snowblower. As discussed above, the term "area" can refer to sidewalks and other known pedestrian walkways such as walking paths, stairs, patios and decks, as well as driveways and certain roadways, parking areas and alleyways that can be cleaned after a snowstorm with a machine including at least one rotating auger or impeller. As discussed below, the snow removal machine 10 operates to remove snow from an area in the same manner as a conventional snowblower that is self propelled or attached to a separately driven vehicle. The snow removal machine 10 includes a housing 20, a motor 40 and an application system 100 for delivering surface treatment material to the path.

Figure 2:
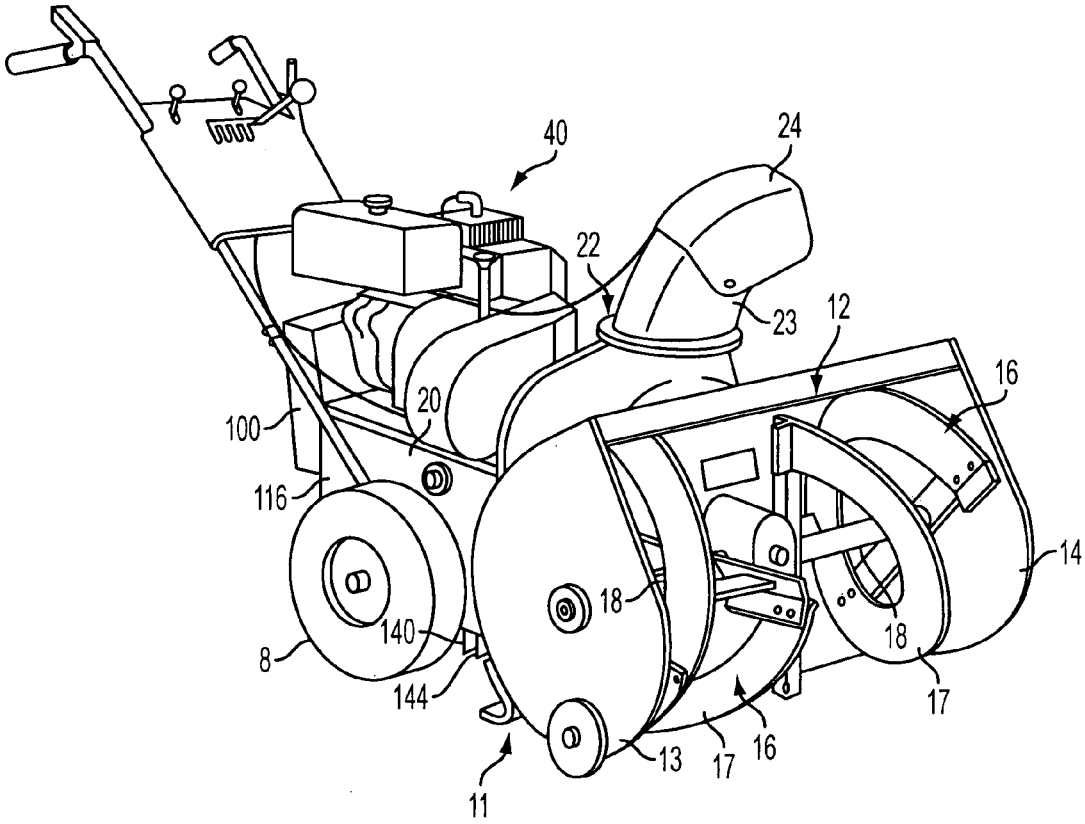
FIG. 2 is a front perspective view of a snow removal machine according to an aspect of the present invention.

The snow removal machine housing 20 is similar in shape and structure to that of a conventional snowblower as illustrated in the Figures. The Figures illustrate various snowblowers for the purpose of illustration. It should be understood that other types of snowblowers or snow removing machines may be used with the present invention. The housing 20 includes a front sub-housing 11 having an opening 12 through which the snow to be removed enters the sub-housing 11. As shown in FIG. 2, the opening 12 extends across the path of travel of the machine 10 and between opposed sidewalls 13, 14. The sub-housing 11 also carries at least one conventional rotatable member 16 that contacts and cuts the snow that enters opening 12. The rotatable member 16 also causes the snow to move within the sub-housing 11. In the embodiment shown in FIG. 2, the rotatable member 16 includes at least one auger 17 having a plurality of blades for contacting, cutting and moving the snow within the sub-housing 11 as is well known. In another embodiment shown in FIG. 1, the rotatable member 16 includes at least one impeller 16' having a plurality of blades or brush members for contacting and moving the snow that enters the opening 12. In either embodiment, the rotatable member 16 is secured to and carried by a shaft 18 that has opposite terminal ends rotatably mounted in the sidewalls 13, 14, respectively, of the sub-housing 11 as is well known. The shaft can be driven in any known manner including the use of the motor 40 that drives a chain or drive belt connected to at least one sprocket wheel or pulley at the end of the shaft. The sub-housing 11 can have any conventional shape that permits snow to enter the opening 12, be manipulated by the rotating member 16, and thrown away from the sub-housing 11.

In one embodiment, the snow removal machine 10 is a two-stage snow removal machine that includes a conventional, articulated snow-ejection tube assembly 22 including a snow exhaust chute 23 rotatably mounted on the housing 20 in a conventional manner, as shown in FIG. 1. The snow-ejection tube assembly 22 is aligned above a rotating fan 19 positioned within the sub-housing 11. As is known, the fan 19 forces the snow received within the sub-housing 11 and manipulated by the rotating member 16 out through the exhaust chute 23 so that the snow is thrown away from the snow removal machine 10. The snow exhaust chute 23 can include a pivoting end piece 24 for altering the path along which the snow is thrown by the fan 19.

In another embodiment shown in FIG. 1, the snow removal machine 10 is a one-stage machine that includes a rotating member 16' (an impeller) that gathers the snow that enters the sub-housing 11 through the opening 12 and throws the snow away from the snow removal machine 10. As known, in a one-stage snow removal machine, the impeller 16' is the powered member used for manipulating the snow that enters the opening 12 and throwing the snow out the snow exhaust chute 23. The impeller 16' may be journalled into the sidewalls 13, 14 and connected to the motor 40 by a known direct drive mechanism.

In any of the above embodiments, the snow removal machine 10 may also include a surface treatment application system 100 that is mounted on the housing 20 as shown in the Figures. It should be understood that the application system 100 may be mounted to the snow removal machine using various techniques, some of which are depicted by the Figures, or retrofitted to a conventional snow removal machine using various known methods.

In operation, the surface treatment application system 100 applies at least one surface treatment material 200 to the area that is to be deiced. The application system 100 applies the treatment material 200 to the area after the snow removal machine 10 has passed over the area to prevent ice or snow from forming or reforming on the area.

The surface treatment materials 200 can be liquid, sprayable powder, granular, or a mixture of two or more substances. In one embodiment, the surface treatment material 200 may include magnesium chloride as a liquid. The surface treatment material 200 can also include that disclosed in U.S. Pat. No. 5,302,307, which is incorporated by reference. Other treatment materials that may be used with the surface treatment application system 100 include conventionally distributed liquid deicers and/or anti-icing materials such as that sold by Cargill Salt of Cargill, Inc. under the trade name Hydro-Melt.™ Hydro-Melt™ is a liquid deicer/anti-icing composition with corrosion inhibitors that deice at a lower temperature than rock salt. Hydro-Melt™ deicer also works as a pre-wetting agent to prevent ice from forming on a surface (anti-icing). Any other liquid deicer and/or anti-icing agent could also be used, such as liquid calcium chloride, liquid salt brine, liquid potassium acetate, liquid potassium formate, or methanol, or combinations of any of the above listed materials.

Figure 11:
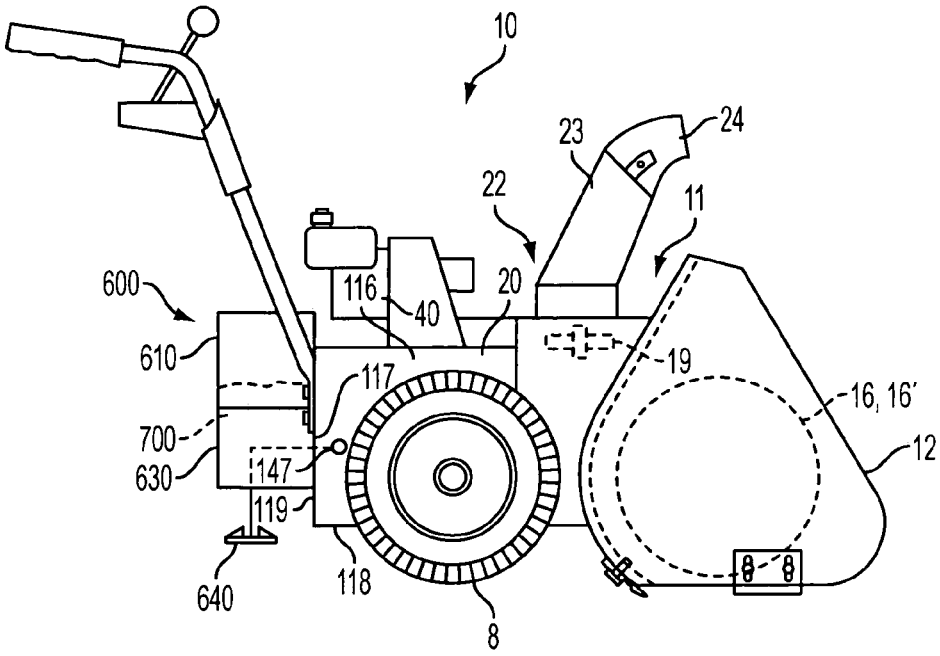
FIG. 11 illustrates a snow removal machine according to the present invention including an alternative system for dispensing a surface treatment material.

In another embodiment, the surface treatment material may include a granular treatment material. "Granular" treatment materials may include at least solid particulate materials, sprayable powders, or solid particulate material and liquid mixtures. Referring to FIG. 11, the surface treatment material 700 includes a conventional road treatment salt, such as rock salt. The treatment material 700 may also include other conventionally distributed granular deicers and/or anti-icing materials such as that sold by Cargill Salt of Cargill, Inc. under the trade name CG90® original and the trade name CG90® Surface Saver®. These treatment materials include rock salt mixed with Monosodium Phosphate, alone or with flake Magnesium Chloride in order to provide improved deicing performance with superior protection against corrosion and scaling along the road surface. Other surface treatment materials include prewetted deicers and/or prewetted anti-icers such as that sold by Cargill Salt under the trade name Clear Lane™ treated salt. This prewetted treatment material includes rock salt mixed with molasses and liquid Magnesium Chloride in order to provide corrosion protection to user equipment while reducing the total amount of salt required for a given area. Numerous other granular deicer and/or anti-icing agents may be used as the treatment material 700. The treatment material applied by the system 100 may include any of the above-mentioned deicer/anti-icing liquid or solid materials in combination with another chemical to allow the other chemical to work for an intended purpose at lower temperatures than it normally works.

Figure 3:
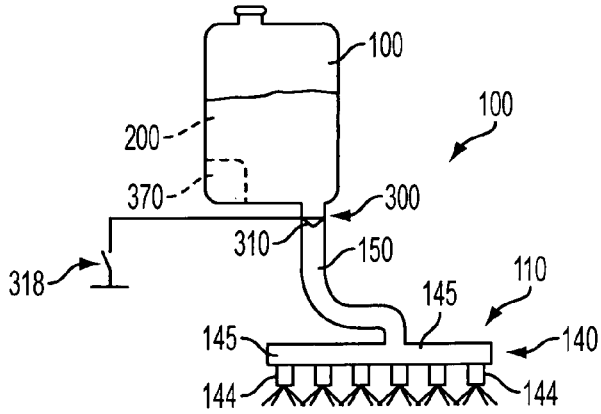
Figure 8:
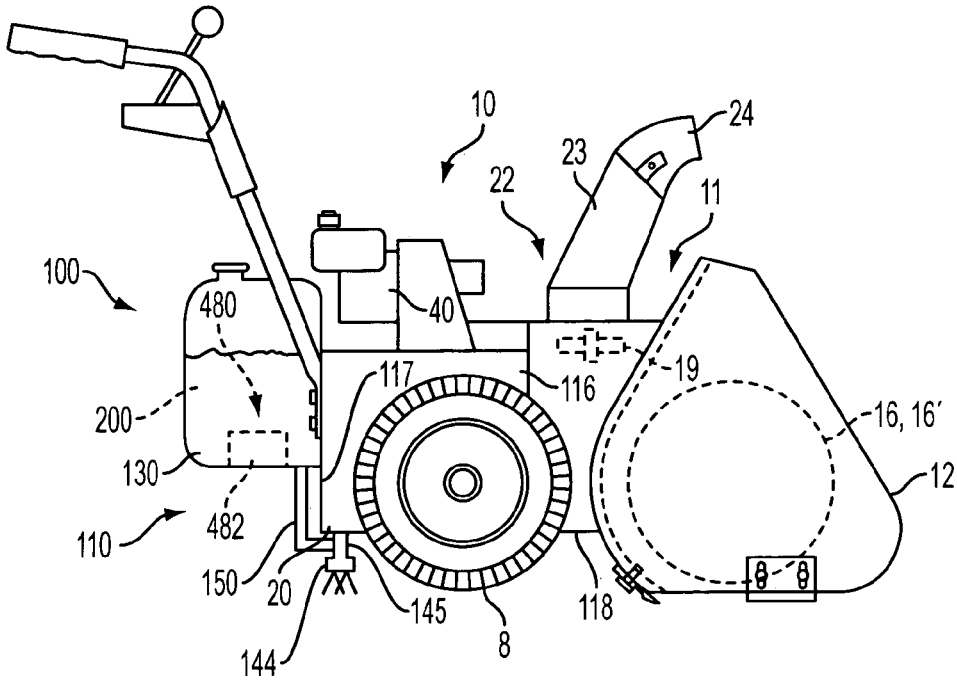
FIG. 8 illustrates an alternative embodiment of the snow removal machine including a system for heating treatment materials according to an aspect of the present invention.

As shown in FIGS. 1–3, in one embodiment, the surface treatment application system 100 includes a material dispensing system 110 that applies the surface treatment material to the area from which some snow has been removed. As depicted, the material dispensing system 110 can be positioned at the rear of the housing 20. In a first embodiment, the material dispensing system 110 is removably or permanently secured to the rear vertical wall 117 of the housing 20, as shown in FIG. 1, or to one or more of the vertical sidewalls 116. In a second embodiment, the material dispensing system 110 is removably or permanently secured to the bottom wall 118 of the housing 20 as shown in FIGS. 2 and 8. In a third embodiment, the material dispensing system 110 is removably or permanently secured to an angled wall that extends between the rear vertical wall 117 and the bottom wall 118. At any of the above-discussed locations, the material dispensing system 110 can be mounted to an external surface of its respective wall 117–118 or extend through a respective number of openings in its respective wall. In yet another alternative embodiment, the material dispensing system 110 can include multiple sub-systems that are positioned at different locations around the housing. For example, one sub-system may be secured on the bottom wall 118 and the other sub-system could be secured on the rear vertical wall 117. It should be understood that all the embodiments of the material dispensing system can be removably or permanently positioned, mounted, or retrofitted at other locations on the housing 20 that are behind the mouth 12.

Figure 5:
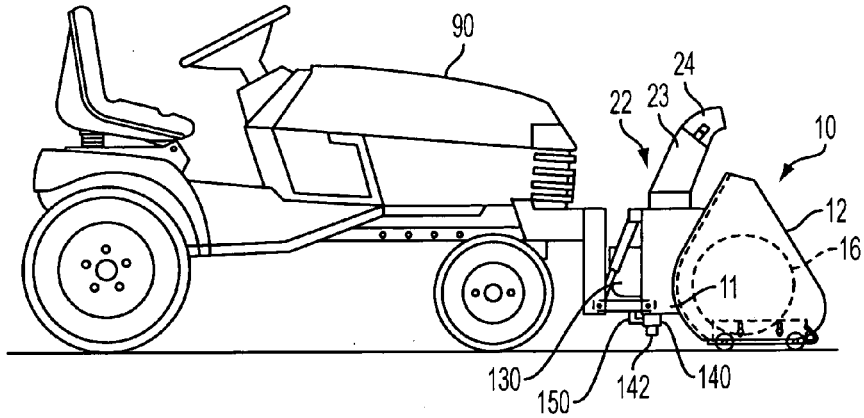
FIG. 5 illustrates a snow removal machine according to an aspect of the present invention that is propelled by a vehicle positioned behind a machine housing.
Figure 6:
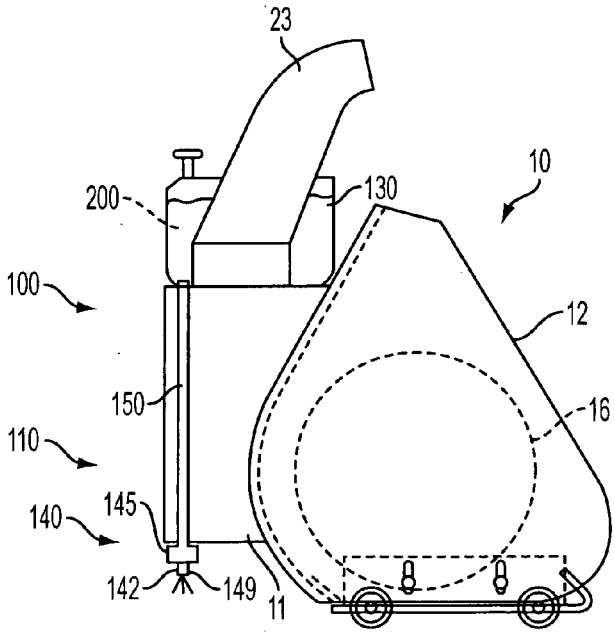
FIG. 6 illustrates the snow removal machine of FIG. 5.

As shown in the Figures, the material dispensing system can include one or more members for applying the solid or liquid treatment material 200 to the area that has been cleared by the snow removal machine 10. In one embodiment that applies a liquid treatment material 200, the material dispensing system 110 may include at least one spray mechanism 140 for the treatment material. In the embodiment shown in FIGS. 5 and 6, the spray mechanism 140 includes a single spray nozzle 142, such as a spray jet, that is sized so that its spray zone covers the entire area behind the snow removal machine 10 but will not spray on the snow removal machine 10, any vehicle 90 pushing the snow removal machine 10, or the feet of the operator. The nozzle 142 can be any known nozzle that can provide a spray rate of between about 0.1 and 1.0 gallons per minute (gpm). In an illustrative range, the nozzle could provide a spray rate of between about 0.2 0.8 gpm. Suitable nozzles include three orifice nozzles available from Streamjet™ under the product codes SJ3-03-VP or SJ3-08-VP. These nozzles can provide a flow rate of between about 0.24 and 0.35 gpm, or 0.56 and 0.94 gpm, respectively, at about 20 to about 60 psi. Nozzles including more than three orifices, including five orifice nozzles, can also be used. Multiple orifice nozzles permit the nozzles on a single fitting to be rotated until one of the orifices providing a predetermined flow rate at a particular pressure is pointed toward the area to be treated for delivering the treatment material to the area.

The term "spray zone" relates to the size of the surface area that will be covered when a fluid is sprayed from a given nozzle. As understood, the size of the spray zone for the nozzle 142 will vary with the size of the path taken by the snow removal machine 10. The size of the spray zone for nozzle 142 and the other spray nozzles discussed herein can be varied by adjusting the size of the spray aperture 149 of the respective nozzle as is known or adjusting the pressure at which the treatment material 200 is applied by the respective nozzle. An illustrative spray zone includes a region that extends behind the snow removal machine 10, in front of the operator, and at least substantially between the sidewalls 13, 14 or to a point between about one inch to about twelve inches on either side of the sidewalls 13, 14.

Figure 4:
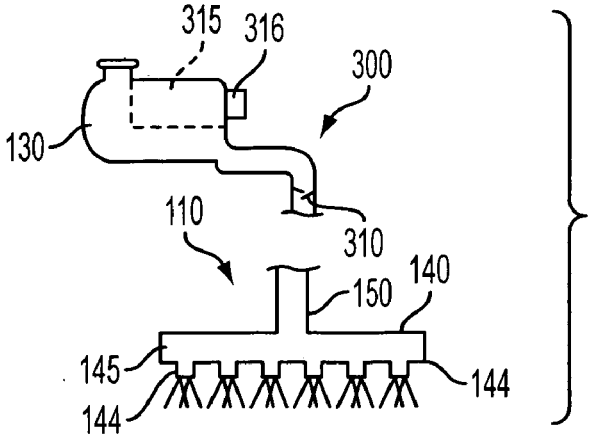
FIGS. 3 and 4 illustrate alternative treatment material application systems according to an aspect of the present invention having different fluid flow control systems.

In another embodiment shown in FIGS. 3 and 4, the spray mechanism 140 includes multiple spray nozzles 144, including spray jets, that are secured directly to the interior or exterior of the housing 20 or secured and spaced along a spray bar 145 that is connected to the housing 20 at any of the above-discussed locations. These nozzles can include any of the above-discussed nozzles including those providing a flow rate of between about 0.1 gpm and 1.0 gpm. However, other conventional spray nozzles can also be used. Each of the nozzles 144 is spaced from an adjacent nozzle 144 along the housing 20. Adjacent nozzles 144 are also spaced from each other along the spray bar 145. The spacing between adjacent nozzles 144 on either the spray bar 145 or the housing 20 will vary depending on the spray zone of each nozzle, the area to be treated and/or the size of the path cleaned by the snow removal machine 10. For example, if four nozzles 144 are spaced along a twenty-four inch wide snow removal machine 10 (between the sidewalls 13, 14), the nozzles 144 could be spaced six inches apart from each other on center, and the outermost nozzles 144 would be spaced about two inches inward from the sidewalls 13, 14.

As shown in FIGS. 1–3, the surface treatment application system 100 also includes a reservoir 130 that can be positioned at any location on the housing 20 that allows the contained treatment material 200 to flow to the material dispensing system 110. In one embodiment, the reservoir 130 may be secured to the rear vertical wall 117 of the housing 20 at a positioned proximate the handles, as shown in FIG. 1. However, other locations that permit the treatment material 200 to be delivered to the material dispensing system 110 can also be used.

The reservoir 130 can be sized to have any capacity for holding the treatment material 200. The capacity of the reservoir 130 can change as the overall size of the snow removal machine 10 changes. For example, the reservoir 130 for a snow removal machine 10 having an eighteen-inch wide opening 12 could be the same or smaller than the reservoir of a snow removal machine 10 having a twenty-eight inch wide opening 12. In an embodiment, the reservoir can have the capacity to hold from about 1 to 5 gallons of the treatment material 200. However, reservoirs 130 with larger or smaller volumes could be used depending on the needs of the customer, the size of the snow removal machine 10, and the area to be treated behind the snow removal machine 10. The reservoir 130 can be formed of any known material that can hold the treatment material 200 without degrading. In an illustrative embodiment, the reservoir 130 may be formed of a plastic or polymer, or other suitable material.

Figure 9:
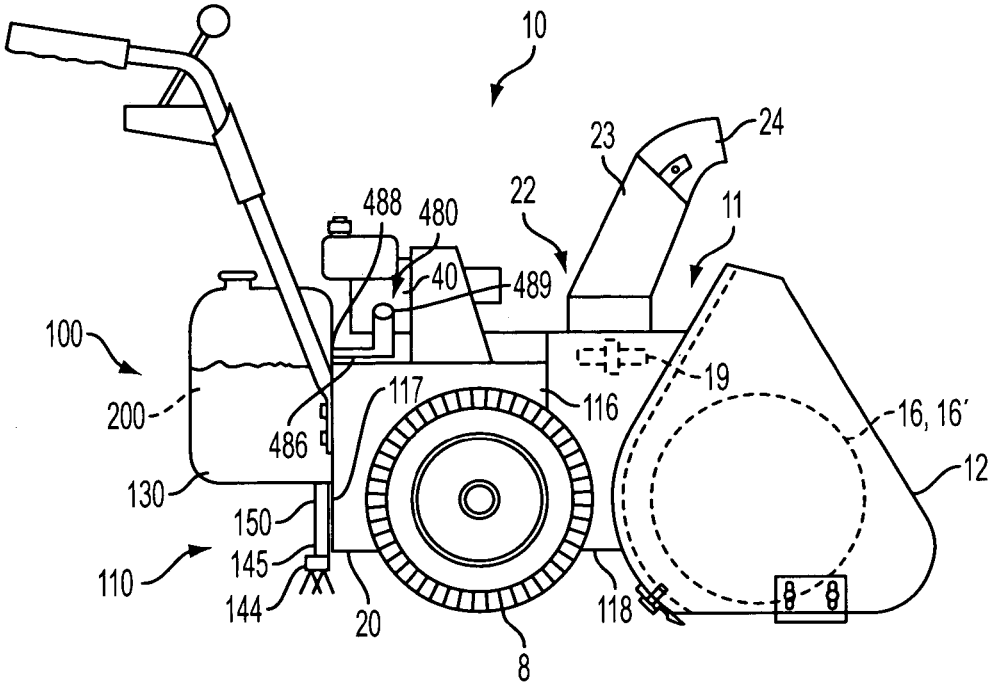
FIG. 9 illustrates an alternative embodiment of the snow removal machine including a system for heating treatment materials according to an aspect of the present invention.

As shown in FIGS. 8 and 9, the reservoir 130 can also include a system 480 for applying heat to the contained treatment material 200. The heating system 480 could maintain the treatment material 200 at a temperature range of approximately 20 to 220 degrees Fahrenheit. However, the temperature range for each treatment material 200 may vary depending on the type of treatment material. For example, the temperature range for a methanol based treatment material may be between approximately 20 and 80 degrees Fahrenheit. The temperature achieved by the system 480 can also depend on the volatility of the treatment material.

As shown in FIG. 8, the reservoir 130 can include a heating member 482 such as a heating coil that can be selectively activated by the operator to maintain the treatment material 200 at a predetermined temperature. As mentioned above, the temperature can depend on the treatment material being used because some materials may be more volatile than others at higher temperatures. In another embodiment illustrated in FIG. 9, the system 480 for applying heat to the contained treatment material 200 could include a conduit 486 secured at a first end to an opening 488 in the reservoir 130 and at a second end 489 over a portion of the exhaust manifold or muffler of the machine 10. In this embodiment, at least a portion of the hot gaseous exhaust from the engine of the machine 10 may be directed into the reservoir 130 in order to maintain the treatment material at a predetermined temperature. Alternatively, the conduit 486 may extend through a recess in the sidewalls of the reservoir 130 and provide heat transfer to the treatment material 200 within the reservoir 130 through the walls of the reservoir 130. In this embodiment, at least a portion of the reservoir 130 and the conduit 486 may be formed of a material with thermal conductivity. In at least one embodiment, this thermally conductive material could be a metal. Further, the reservoir may be heated electrically or using radio frequency heating.

Alternatively, or in addition to the above-discussed reservoir heating systems, the conduits to the nozzles and/or the nozzles themselves may be heated to prevent clogging and/or to increase the thermal melting ability of the treatment material being applied. Further, the snow removal machine 10 can include a system for heating the surface from which the machine removes snow. For example, the snow removal machine 10 could include a radiant heating element or airflow raised to a temperature between about 100 to 300 degrees Fahrenheit to assist in the melting of the snow/ice by preheating the surface of the area over which the treatment material will be applied. Of course temperatures outside this range may also be used. In the heated material examples contained herein, it may be beneficial to actively heat that material to be dispensed (liquid, solid, powder, gel, and the like) above the temperature of the snow and/ice on the ground. This heating of the surface may also improve the deicing and/or anti-icing capability of the treatment material by creating a surface that may readily accept the deicer and/or anti-icing treatment material and increase its activation time.

In any of the above-discussed embodiments, a fluid flow conduit 150, shown in FIGS. 1 and 3, such as a tube formed of plastic, polymer or composite materials, extends between the reservoir 130 and the spray nozzle(s) to deliver the treatment material 200 to the respective nozzle(s). The flow conduit 150 can be secured at a first end to the reservoir 130 and at a second end to the nozzle(s) or spray bar 145 in any conventional manner.

As shown in FIG. 3, the treatment application system 100 also includes a system 300 for controlling the amount of treatment material 200 that is applied to the area being treated. In a first embodiment, the control system 300 may include a one-way check valve 310 that can be electrically or mechanically operated to permit fluid to flow from the reservoir 130 to the nozzle(s) of the material dispensing system 110 when the check valve 310 is open. The valve 310 can be any known one-way check valve including but not limited to a flapper valve or a duck bill valve. This valve 310 can be positioned at any point along the flow conduit 150. In an embodiment, the opening of valve 310 can be set so that it automatically opens whenever the drive system of the snow removal machine 10 is engaged and closed when the drive system is disengaged. An override switch that allows the operator to close the valve 310 while the drive system is engaged could also be included. Additionally or alternatively, the snow removal machine 10 may include a switch 318 that permits the operator to manually open the valve 310 when the switch 318 is closed and close the valve 310 when the switch 318 is opened in order to control the release of the treatment material 200 from the reservoir 300. Switch 318 can be independent of the operation of the drive system of the snow removal machine 10.

Figure 7:
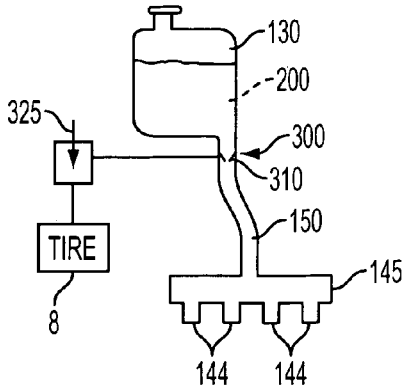
FIG. 7 illustrates a treatment material application system having a fluid control system according to embodiments of the present invention.

In another embodiment shown in FIG. 7, a sensor 325 may be used that determines the condition of the surface over which the rear tires 8 of the snow removal machine 10 are traveling and controls the opening and closing of the valve 310. For example, the sensor 325 can determine when either of the tires 8 is slipping on the surface over which the sub-housing 11 has just passed and cause the valve 310 to open in response to sensed slippage. Conventional sensors, such as those used with all-wheel drive vehicles that sense when a wheel is slipping, can be positioned on the snow removal machine 10 for sensing when a tire 8 is not gripping a surface and when the treatment material 200 may need to be applied. Alternatively, the sensor 325 can be a level sensor that determines when at least one of the tires 8 is raised off the ground as a result of a buildup of snow, slush and/or ice on the surface over which the sub-housing has passed. "Tires," as used herein, is a generic term that also includes tracks and other ground engaging members used to move a machine over ground. The level sensor 325 can detect when at least one of the tires 8 is deflected at an angle relative to the other tire 8 or the front opening 12 due to a build-up of snow and/or ice on the area being cleaned. The angle that activates the sensor 325 can be a predetermined angle of about five to ten degrees or greater. When the level sensor determines that the predetermined angle has been reached, it will cause the valve 310 to open and the spray of treatment material to be delivered to the surface via the nozzle(s).

In yet another alternative embodiment, the machine 10 includes a known logics control system that causes the valve 310 to open and causes pumps associated with the nozzles to operate and spray the treatment material 200 at predetermined time intervals. These time intervals can be directly related to the size of the spray zone of each nozzle. For example, the greater the spray zone for each nozzle, the larger the time interval between each spraying. The time intervals between each spraying can be from about 1 second to about 10 seconds. In an embodiment, the time interval between each spraying is between about 2 and 6 seconds. However, as mentioned, the actual time interval will vary depending on the spray zone of each nozzle and the amount of time that each nozzle operates as it is spraying. Alternatively, as discussed, the nozzles could provide a continuous spray while the wheels or tires 8 are moving.

In order to create pressure within the line 150, a small pump 370 can be positioned within the reservoir 130, as shown in FIG. 3. A conventional, fluid submersible pump having a horsepower in the range of about 1/200 HP to about 1/100 HP could be used. These pumps can provide a flow rate of between about 0.3 to 3.0 gpm. Additionally, small pumps can also be positioned within the spray nozzle(s) to increase the pressure and flow rate at which the treatment material is sprayed on the area being treated. Conventional powered spray nozzles that provide the above-discussed flow rates can be used. By controlling the strength of one or more of the pumps, the spray zone of the nozzle(s) and the flow rate of the treatment material can be controlled so as to reduce waste. In another embodiment, a known pump (not shown), such as an air pump, could be positioned on the exterior of the reservoir 130. When activated, the air pump would increase the pressure within the reservoir 130 so that the pressure within the reservoir 130 was greater than the resistance of valve 310 and the liquid treatment material 200 would be forced through the conduit 150 and to the nozzle(s) under the pressure created by the air pump.

Figure 10:
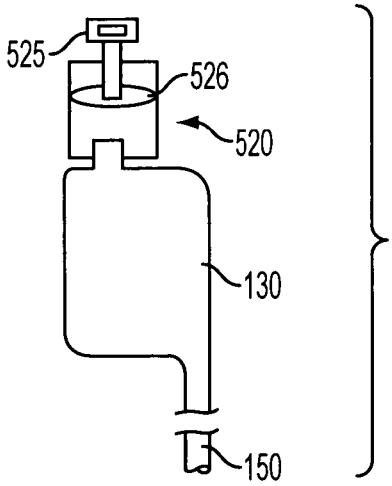
FIG. 10 illustrates an alternative embodiment of a system for increasing fluid pressure within a treatment material reservoir according to an aspect of the present invention.

In another embodiment illustrated in FIG. 10, fluid pressure within the reservoir 130 can be increased using a manual pump 520 having a manually manipulated handle 525 connected to an internally positioned diaphragm 526. In an embodiment, this pump could be formed as a portion of the reservoir 130. In another embodiment, the pump 520 could be secured to the reservoir 130 by attaching it to cooperating threads or other known locking systems that surround an opening to the reservoir 130, such as a fluid introduction opening. In operation, the operator would reciprocate the handle 525 and the diaphragm 526 of the pump 520 in order to introduce air into the reservoir 130 and, thereby, increase the air pressure within the reservoir 130. The pumping action continues until a desired amount of fluid pressure is built up within the reservoir 130 to provide a sufficient flow rate of the treatment material 200. The created pressure within the reservoir and resulting flow rate will cause the treatment material 200 to flow through the valve 310 and to the nozzle(s) for being sprayed on the area to be treated. The created pressure could have a magnitude of about 20 psi to about 100 psi in order to cause a flow rate of between about 0.2 and 1.0 gpm.

In additional embodiments, pressure can be increased within the reservoir 310 and pressure levels established using exhaust from the engine manifold. In this embodiment, the exhaust from the engine manifold would be directed into the reservoir 310 or a bladder 315 (FIG. 4) positioned above the reservoir 310 through an opening 316 so that the pressure within the reservoir 310 is increased to a desired level during the operation of the engine. The reservoir 310 or bladder 315 can include a relief valve that permits the exhaust to exit if the pressure within the reservoir 310 is at or above the level needed to overcome the check valve 310 or provide the desired amount of pressure needed to achieve a particular spray zone and flow rate.

In yet a further embodiment, gravity can be used to deliver fluid to the nozzle(s). In this embodiment, the above-discussed pumps associated with the nozzle(s) will distribute the fluid at a predetermined flow rate and in a predetermined spray zone. Additionally, the nozzle(s) could be free of a fluid pump. In such an embodiment, gravity would deliver the treatment material from the nozzle(s) to the surface to be treated.

Figure 12:
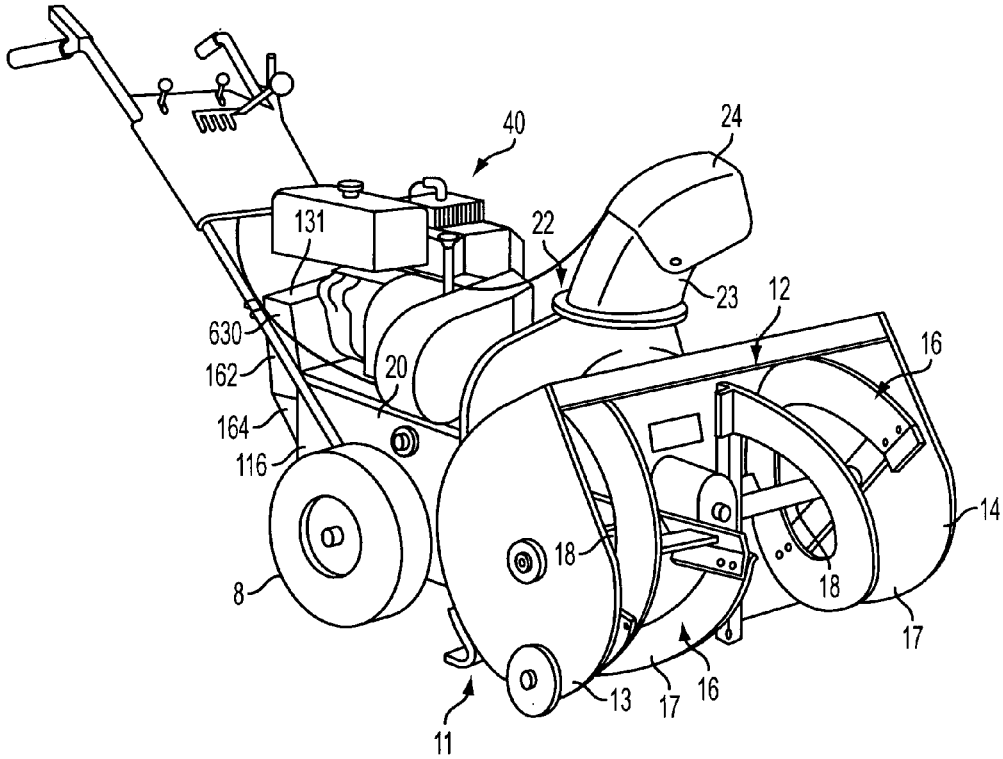
FIG. 12 is a front perspective view of a snow removal machine according to the present invention.
Figure 15:
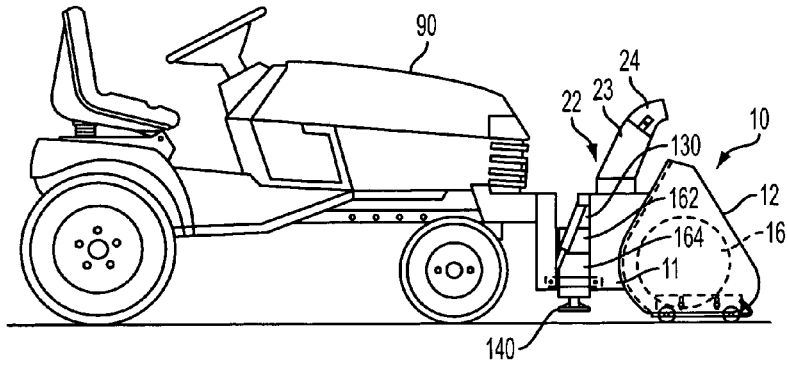
FIG. 15 illustrates a snow removal machine according to the present invention that is propelled by a vehicle positioned behind a machine housing.
Figure 16:
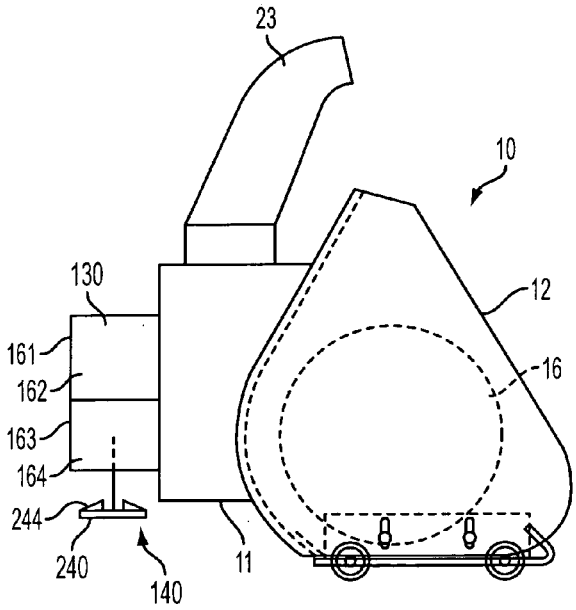
FIG. 16 illustrates the snow removal machine of FIG. 15.

As shown in FIGS. 11–19, alternative embodiments of the surface treatment application system apply a granular surface treatment material to the area from which the snow has been removed. As shown in FIG. 11, the surface treatment application system 600 includes a material dispensing system 610 that applies the granular surface treatment material 700 to the area to be treated. The size of the area over which the treatment material 700 is supplied will vary with the size of the path taken by the snow removal machine 10. Referring to FIG. 12, an illustrative area is that which includes a region that extends behind the snow removal machine 10, in front of the operator, and at least substantially between the sidewalls 13, 14 or to a point between about one inch to about twelve inches on either side of the sidewalls 13, 14.

As shown in FIGS. 11 and 12, the material dispensing system 610 can be positioned at the rear of the housing 20. Similar to the above embodiments, the material dispensing system 610 may secured to the rear vertical wall 117 of the housing 20, or to one or more of the vertical sidewalls 116. Alternatively, the material dispensing system 610 is secured within the housing 20. At any of the above locations, the material dispensing system 610 can be removably or permanently secured or retrofitted to the housing 20.

In an alternative embodiment, the material dispensing system 610 can include multiple dispensing systems 610 positioned at different locations around the housing 20. For example, one sub-system could be secured on a first rear side edge 119 of vertical wall 117, and the other sub-system could be secured on the other rear side edge 119 of the vertical wall 117. It should be apparent that one or more of the material dispensing systems 610 may be positioned at any location on the housing 20 to permit the treatment material 700 to be broadcasted over the area that has been cleared by the snow removal machine 10.

The material dispensing system 610 can include one or more broadcasting members 640 that spread the treatment material 700 over the area from which the snow has been removed by the snow removal machine 10. In one embodiment, the material dispensing system 610 includes a hopper 630 with an open interior 131 for receiving and holding the treatment material 700. The material dispensing system 610 also includes at least one broadcasting member 240 operatively associated with the hopper 630 for broadcasting the treatment material 700 over the area to be treated.

The hopper 630 can be sized to have any capacity for holding the treatment material 700. The capacity of the hopper 630 can change as the overall size of the snow removal machine 10 changes. For example, the hopper 630 for a snow removal machine 10 having an eighteen-inch wide opening 12 could be the same or smaller than the hopper 630 of a snow removal machine 10 having a thirty-two inch wide opening 12. In an embodiment, the hopper 630 can have the capacity to hold from about one pound of the treatment material 700 to about ten pounds of the treatment material 700. In an embodiment, the hopper 630 can carry between two and five pounds of the treatment material 700. However, the hoppers 630 can carry larger or smaller volumes of the treatment material 700 depending on the needs of the customer, the size of the snow removal machine 10, and the area to be treated behind the snow removal machine 10. The hopper 630 can be formed of any known material that can hold the treatment material 700 without degrading. For example, the hopper 630 may be formed of a metal, plastic, polymer, or other suitable material.

Figure 13:
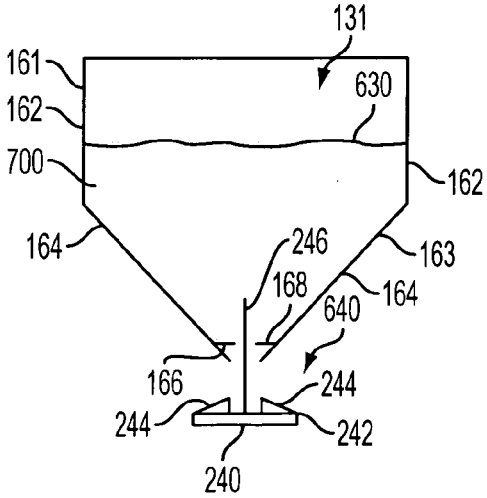
FIGS. 13 and 14 are schematic illustrations of alternative treatment material application systems according to the present invention.

The hopper 630 can have any known shape that directs a granular material toward the broadcasting member 640. Also, the hopper 630 can include multiple sections, each with a different shape. For example, as shown in FIG. 13, the hopper 630 can include a substantially rectangular upper portion 161 having a pair of substantially vertical upper sidewalls 162. The hopper 630 can also include a lower, triangular shaped portion 163 having a pair of substantially converging lower sidewalls 164 that form a substantially V-shaped portion of the hopper 630. The lower V-shaped portion 163 of the hopper 630 directs the treatment material 700 within the hopper. 630 toward the apex of the two sidewalls 164 as the treatment material 700 is dispensed from the hopper 630. In an alternative embodiment illustrated in FIG. 14, the sidewalls 172 of the hopper 630 converge toward each other from their upper surfaces in order to form a substantially V-shaped receptacle for holding the treatment material 700. However, as discussed above, the hopper 630 is not limited to only the above-discussed shapes. Rather, the hopper can have any known shape that directs the treatment material toward a discharge opening 166 located at the lowest point of the hopper 630 for delivering the treatment material 700 to the broadcasting member 640.

Figure 14:
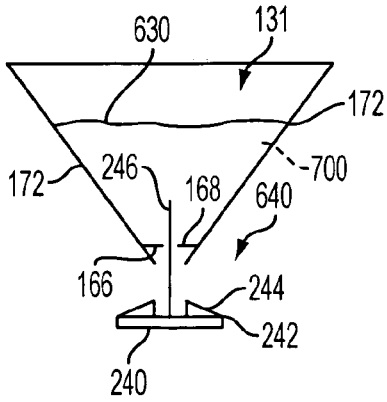

As shown in FIG. 13, the broadcasting member 640 is positioned outside the hopper 630 at a location that is proximate and adjacent to the discharge opening 166. The broadcasting member 640 includes a rotatable plate 240 with an upper surface 242 and a plurality of spaced ribs 244. An axis of rotation 246 of the plate 240 is vertically oriented so that it extends substantially parallel to the height of the hopper 630. The plate 240 is aligned with the discharge opening 166 for receiving any treatment material 700 that exits the discharge opening 166. As illustrated in FIGS. 13 and 14, the ribs 244 extend radially away from the center of the plate 240 and vertically away from the upper surface 242 of the plate 240. Also, the ribs 244 cooperate with the rotational motion of the plate 240 to spread the treatment material 700 over a predetermined portion of the area to be treated.

Figure 19:
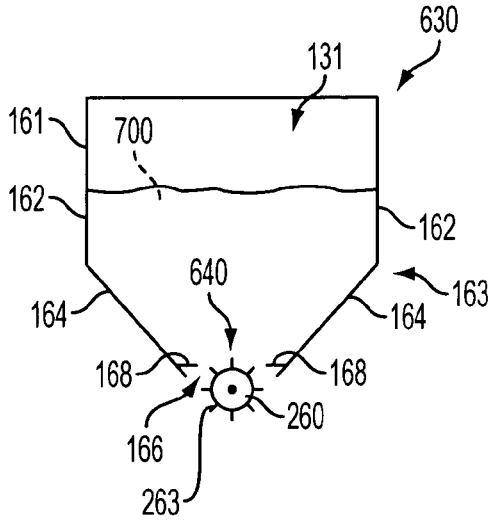
FIG. 19 is a schematic view of the alternative embodiment of the treatment material application system illustrated in FIG. 18.

In an alternative embodiment illustrated in FIG. 19, the broadcasting member 640 is positioned at least partially within the hopper 630 proximate and adjacent to an inner surface of the discharge opening 166. The broadcasting member 640 may include a rotatable cylinder 260 having a plurality of ribs 263 that extend radially outward from the outer surface of the cylinder 260 and along the length of the cylinder 260 in a direction substantially parallel to the longitudinal of axis of the cylinder 260. Each rib 263 is angularly displaced from an adjacent rib 263 along the circumference of the cylinder 260. The ribs cooperate with the rotation of the cylinder 260 to broadcast the treatment material over a predetermined area. The axis of rotation of the cylinder 260 can extend in a direction between the sidewalls 13, 14 of the snow removal machine 10 or in a direction extending between the front and back of the snow removal machine 10.

Figure 18:
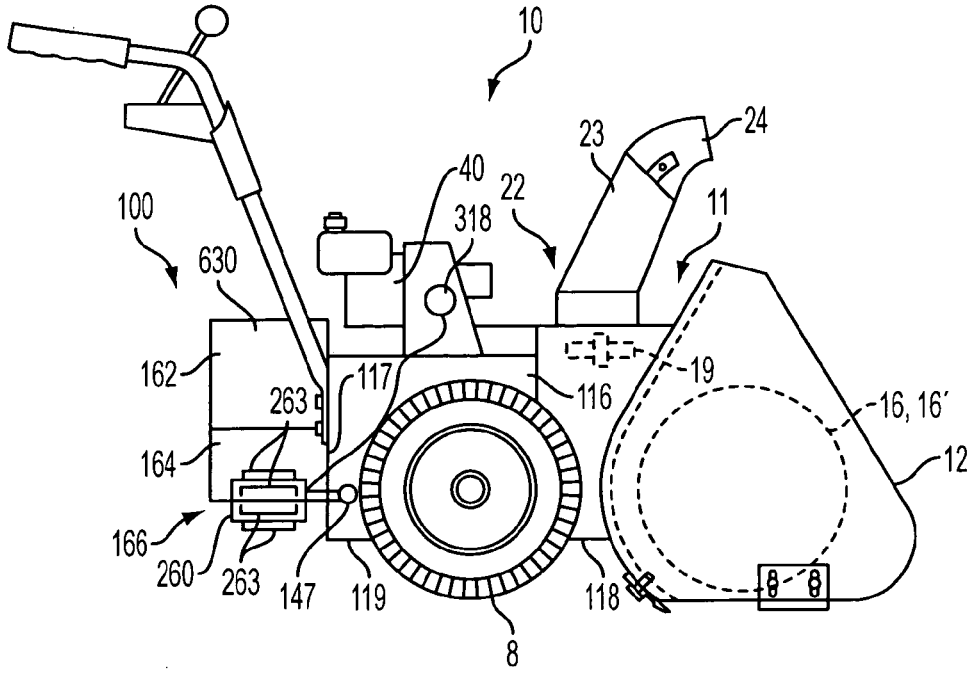
FIG. 18 illustrates a snow removal machine according to the present invention including an alternative embodiment of a system for dispensing a surface treatment material.

In either of the above embodiments, the broadcasting member 640 can be rotated either manually or automatically or both. In a first embodiment, the broadcasting member 640 is rotated manually as an operator rotates an associated crank. In an alternative embodiment, a powered motor rotates the broadcasting member 640 automatically at a single predetermined speed or at one of multiple preset speeds. As illustrated in FIGS. 11 and 18, the motor 147 is a dedicated motor that only operates to rotate the broadcasting member 640. In such an embodiment, the motor 147 can be set to operate whenever the motor of the snow removal machine 10 is operating or the snow removal machine 10 can include a switch for selectively activating and deactivating the dedicated motor 147. The motor 147 may be battery, electric, or gas powered depending on the type of motor used.

Alternatively, a pair or gears or pulleys and cooperating belts can operatively connect the broadcasting member 640 to an output shaft of the motor 40 of the snow removal machine. As a result, the broadcasting member 640 will rotate when the motor 40 of the snow removal machine 10 is operating. A clutch or switch can be included to selectively deactivate and activate the rotation of the broadcasting member 640. In yet another embodiment, the exhaust from the engine 40 can be passed over a rotatable member, such an impeller, which is operatively connected to the broadcasting member 640 and causes the broadcasting member 640 to rotate in response to its own movement.

In any of the above embodiments, the broadcasting member 640 distributes the treatment material 700 as it rotates so that the treatment material 700 covers the area that has been cleaned behind the snow removal machine 10. The broadcasting member 640 is not intended to apply the treatment material 700 on the snow removal machine 10, any vehicle pushing 90 the snow removal machine 10, or the feet of the operator. Alternatively, to assist in distributing the deicing and/or anti-icing material, the broadcast member 640 may direct the treatment material 700 to a faring on snowblower, where the faring directs the treatment material to the ground. This diverted treatment material 700 may provide the benefit of preventing the broadcast member 640 (or nozzles in terms of a liquid or gel-type material) from becoming clogged or disabled. The size of the disbursement area for the treatment material 700 will vary depending on the amount of ice and/or slush that remains on the area after the snow removal machine 10 passes over it, the amount of desired overlap for the treatment material 700 between adjacent passes of the snow removal machine 10, the speed at which the broadcasting member 640 rotates and/or the size of discharge opening 166.

The size of the discharge opening 166 of the hopper 630 can be adjusted to alter the amount of treatment material 700 released from the hopper 630. As the size of the discharge opening 166 is increased, there will be an increase in the amount of treatment material 700 released from the hopper 630. Similarly, when the size of the discharge opening 166 is reduced, the amount of treatment material 700 released will be reduced. A panel 168 or multiple panels (not shown) can be used to adjust the size of the discharge opening 166. The panel(s) 168 can be secured to a first end of a cable. The second end of the cable can be secured to a pulley that is manually controlled and rotated as an operator rotates a corresponding dial. Depending on the direction the dial is rotated, the size of the discharge opening 166 will either be increased or decreased. Alternatively, a logics circuit can be used to alter the size of the discharge opening 166 in response to data provided by an operator. For example, the position of the panel(s) 168 relative to the discharge opening 166 can be automatically altered in response to a flow rate entered into a controller for the logics circuit by an operator of the snow removal machine 10 in order to increaser or decrease the size of the discharge opening 166.

In an embodiment, the opening of discharge port 166 can be set so that it automatically opens whenever the drive system of the snow removal machine 10 is engaged and closed when the drive system is disengaged. An override switch that allows the operator to close the discharge opening 166 while the drive system is engaged could also be included. Similarly, as shown in FIG. 18, the snow removal machine 10 can include a switch 318 that permits the operator to manually open the panel(s) 168 and close the panel(s) 168 when the snow removal machine 10 is not operating. The switch 318 may be independent of the operation of the drive system of the snow removal machine 10.

Figure 17:
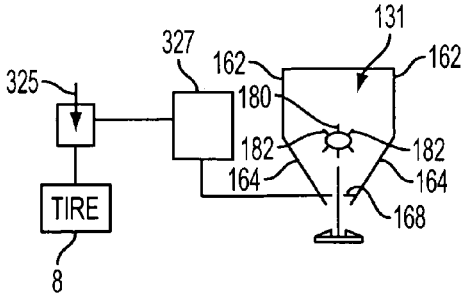
FIG. 17 illustrates a treatment material application system having a motor control system for adjusting a treatment material discharge opening according to embodiments of the present invention.

As shown in FIG. 17, and similar to FIG. 7, a sensor 325 may be used that determines the condition of the surface over which the rear tires 8 of the snow removal machine 10 are traveling and controls the opening and closing of the panel(s) 168. As stated above, the sensor 325 can determine when either of the tires 8 are slipping on the surface over which the sub-housing 11 has just passed and cause a motor 327 to operate, which in turn, causes the panel(s) 168 to open in response to sensed slippage. The size of the discharge opening 166 can be preset by the operator or controlled by the sensor 325 in response to the sensed condition. Similar to the above embodiments, the sensor 325 may be any conventional sensor, including a level sensor, that will serve to control the opening and closing of the panel(s) 168 thereby controlling the amount and rate of treatment material 700 delivered to the broadcasting member 640.

As illustrated in FIG. 17, the hopper 630 can include a rotatable member 180, such as an auger, that extends within the interior chamber 131 of the hopper 630 for agitating the carried treatment material 700. An outer surface of the rotating member 180 can include a plurality of members 182, such as longitudinally extending blades or circular blades, for engaging and agitating the contained treatment material 700 so that the treatment material 700 is directed toward the discharge opening 166.

The rotatable member 180 can be manually rotated by a crank or automatically rotated when a motor (not shown) linked to the member 180 is activated. The motor can be a dedicated motor that is independent of the motor 40 of the snow removal machine 10. Alternatively, the rotatable member 180 can be rotated by a belt, chain or other known drive system operatively attached to an output shaft of the motor 40 of the snow removal machine 10. As the agitating member 180 rotates, it will keep the treatment material 700 separated and move it in the direction of the opening 166.

The agitating member 180 can include heating coils for heating the contained treatment material 700. Alternatively, the agitating member 180 can include openings through which warm exhaust from the motor can be introduced into the interior of the hopper 630 in order to warm the treatment material 700. Further, the treatment material 700 within the hopper 630 may be heated electrically or using radio frequency heating. In any of the above embodiments, the treatment material 700 can be maintained at any temperature that will enhance its effectiveness. For example, the treatment material can be kept at a temperature between approximately 20 and 700 degrees Fahrenheit depending on the treatment material contained within the hopper 13. The temperature achieved within the hopper 630 can depend on the specific treatment material 700 to be applied and the volatility of that treatment material 700. For example, the temperature range for a more volatile treatment material 700 may be between approximately 20 and 90 degrees Fahrenheit. Alternatively, some treatment materials may work best if maintained at a temperature at or greater than 90 degrees Fahrenheit.

Further, the snow removal machine 10 can include a system for heating the surface from which the machine removes snow. For example, the snow removal machine 10 could include a radiant heating element or airflow raised to a temperature range of approximately 300 to 600 degrees Fahrenheit to assist in the melting of the snow or ice by preheating the surface of the area over which the treatment material will be applied. This heating of the surface may also improve the deicing and/or anti-icing capability of the treatment material 700 by creating a surface that may readily accept the deicer and/or anti-icing treatment material and increase its activation time.

In yet a further embodiment, the reservoir or canister holding the deicing/anti-icing material, the material distribution system, and control system that controls the material distribution system may also be sold separate from the snowblower. For example, the deicing/anti-icing system may be sold as a retrofit for existing snowblowers. Accordingly, a purchaser may be provided the option of purchasing a snowblower with the deicing/anti-icing system integrated into it and the option of purchasing the deicing/anti-icing system separately and attaching it to a snowblower. For individuals and institutions having already purchased a snowblower, acquiring only the deicing/anti-icing system may be more cost-effective than purchasing the combination of the snowblower and the deicing/anti-icing system.

While there have been shown and described and pointed out fundamental novel features of the present invention as applied to embodiments thereof, it will be understood that various omissions and substitutions and changes in the form and details of the devices illustrated, and in their operation, may be made by those skilled in the art without departing from the spirit and scope of the invention as broadly disclosed herein. For example, the treatment material reservoir 130 could also include a conduit that supplies the deicer and/or anti-icing material to the snow exhaust chute 23 and/or the rotatable member 16. In addition, the embodiments of the surface treatment application systems described above may be combined to provide a system that applies a liquid and solid surface treatment material. Moreover, it should be understood by those skilled in the art that the above embodiments may be retrofitted with or adapted to conventional snow removal machines 10.

We claim:

1. A walk-behind snow removal machine comprising:

a housing including a forward opening through which snow enters the snow removal machine;

at least one rotatable member positioned within said forward opening for engaging the snow and eliminating the snow from within said housing;

a motor operatively connected to the rotatable member and for propelling said snow removal machine; and a treatment material dispensing system connected to the housing for dispensing a deicer and/or anti-icing treatment material over a surface area, wherein the treatment material dispensing system includes a container for holding the treatment material so as to dispense the treatment material on the surface area after engagement of the snow by the rotatable member, wherein said motor powers said treatment material dispensing system, and the dispensing system is configured to provide heat transfer for maintaining a temperature range environment for the treatment material during the dispensing of the treatment material.

2. The machine of claim 1, wherein said treatment material includes a liquid.

3. The machine of claim 1, wherein said treatment material includes a granular material.

4. The machine of claim 1, wherein said treatment material includes a prewetted granular solid.

5. The machine of claim 1, wherein the motor produces an exhaust and at least a portion of the exhaust provides the heat transfer.

6. The machine of claim 1, wherein the surface treatment application system includes at least one spray nozzle secured to said housing for applying the treatment material to the surface area and a conduit extending between said container and said at least one spray nozzle for delivering the treatment material from the container to the at least one spray nozzle.

7. The machine of claim 6 wherein said at least one spray nozzle includes a single nozzle for dispensing the treatment material.

8. The machine of claim 6 wherein said at least-one spray nozzle includes a plurality of spray nozzles spaced from each other along a surface of said housing.

9. The machine of claim 8 further comprising a spray bar extending along a length of said housing, said spray bar carrying said nozzles and securing said nozzles to said housing.

10. The machine of claim 6 further including a system for applying heat to said treatment material via the conduit.

11. The machine of claim 6 further including a control system for controlling and varying the amount of treatment material provided to the surface area.

12. The machine of claim 6 further including pressure control system for controlling and varying the flow rate of the treatment material provided to the surface area.

13. The machine of claim 1 wherein the the container comprises a hopper for carrying the treatment material, the hopper includes a discharge opening for distributing the treatment material to the surface area.

14. The machine of claim 13 wherein said treatment material includes a granular material.

15. The machine of claim 13 wherein the treatment material dispensing system includes at least one rotatable member for distributing the treatment material to the surface area.

16. The machine of claim 15 wherein said at least one rotatable member includes a rotatable plate spaced from said discharge opening for receiving the treatment material that passes through said discharge opening.

17. The machine of claim 16 wherein said rotatable plate includes a plurality of spaced ribs that extend radially from a center of said rotatable plate.

18. The machine of claim 15 further including a motor operatively coupled to the at least one rotatable member for said heat transfer.

19. The machine of claim 13 further comprising an agitator positioned within said hopper for contacting and agitating the treatment material.

20. The machine of claim 13, wherein the rotatable member is operatively connected to the motor for receiving a portion of exhaust from the motor for said heat transfer.

21. The machine of claim 20, wherein the rotatable member has at least one aperture for releasing said exhaust for said heat transfer.

22. The machine of claim 1, wherein said machine may be used to remove snow from sidewalks and driveways.

23. The machine of claim 1, wherein the dispensing system is operatively connected to the motor for the heat transfer.

24. A walk-behind machine for removing snow from an area, said machine comprising: a housing including at least one rotating member for engaging snow received within said housing, a motor for propelling said machine for removing snow, and a surface treatment material application system associated with said housing for applying a surface treatment material to the area, a heating system associated with the surface treatment material application system and the heating system being operatively connected to the motor for applying heat for maintaining a temperature range environment for the treatment material, wherein said motor powers said treatment material application system.

25. The machine of claim 24 wherein the treatment material includes a deicing material.

26. The machine of claim 24 wherein the treatment material is an anti-icing material.

27. The machine of claim 24 wherein the treatment material includes a deicing material and an anti-icing material.

28. The machine of claim 24 wherein at least a portion of said treatment material application system is positioned on said housing behind a forward opening of said housing that receives snow during the operation of the machine.

29. The machine of claim 24 wherein the surface treatment application system includes a reservoir for carrying the treatment material, at least one spray nozzle secured to said housing for applying the treatment material to the area and a conduit extending between said reservoir and said at least one spray nozzle for delivering the treatment material from the reservoir to the at least one spray nozzle.

30. The machine of claim 29 wherein said at least one spray nozzle includes a single nozzle for dispensing the treatment material.

31. The machine of claim 29 wherein said at least one spray nozzle includes a plurality of spray nozzles spaced from each other along a surface of said housing.

32. The machine of claim 29 further comprising a control system for controlling and varying the amount of treatment material dispensed to the area.

33. The machine of claim 29 further comprising a pressure control system for controlling and varying the flow rate of the treatment material dispensed to the area.

34. The machine of claim 29 further including a system for applying heat to said treatment material within said reservoir.

35. The machine of claim 24 wherein the treatment material application system includes a hopper for carrying the treatment material, the hopper includes an opening for discharging the treatment material.

36. The machine of claim 35 wherein said treatment material includes a deicing material.

37. The machine of claim 35 wherein said treatment material includes an anti-icing material.

38. The machine of claim 35 wherein the treatment material includes a deicing material and an anti-icing material.

39. The machine of claim 35 wherein the treatment material application system includes at least one rotatable member for distributing the treatment material.

40. The machine of claim 39 wherein said at least one rotatable member includes a rotatable plate spaced from said opening for receiving the treatment material that passes through said opening.

41. The machine of claim 39 further comprising a motor operatively coupled to said rotatable plate.

42. The machine of claim 35 further comprising an agitator positioned within said hopper for contacting and agitating the treatment material.

43. The machine of claim 24, wherein said machine may be used to remove snow from sidewalks and driveways.

44. A walk-behind machine for removing snow from an area comprising a housing, at least one rotatable member positioned within said housing for contacting and moving snow within said housing, a motor for propelling said machine for removing snow, means for applying a deicing and/or anti-icing treatment material to the area, and means for applying heat to the treatment material for maintaining a temperature environment for the material, wherein said motor powers said treatment material application system.

45. The machine of claim 44 wherein the treatment material includes a liquid, and said applying means include spraying means for spraying said liquid treatment material to said surface.

46. The machine of claim 45 wherein said spraying means includes at least one spray nozzle secured to said housing.

47. The machine of claim 45 wherein said spraying means includes a plurality of spray nozzles secured to said housing.

48. The machine of claim 45 wherein said spraying means farther includes a spray bar secured to a portion of the housing and said spray nozzles.

49. The machine of claim 44 wherein said applying means includes a reservoir for holding the treatment material, at least one spray means for applying the treatment material to the area being treated, and means for forming a fluid connection between the reservoir and the spray means.

50. The machine of claim 49 wherein said means for forming a fluid connection includes a fluid conduit.

51. The machine of claim 49 further comprising a control system for controlling the amount of treatment material provided to the area.

52. The machine of claim 49 further comprising a flow control system for controlling the flow rate of the treatment material provided to the area.

53. The machine of claim 49 further comprising a heating system for controlling the temperature of the treatment material provided to the area.

54. The machine of claim 44 wherein the treatment material includes a granular material, and the applying means further comprises a granular dispensing means for discharging the granular material over the area.

55. The machine of claim 54 wherein said granular dispensing means includes a hopper and at least one rotatable member at least partially positioned within said hopper, and wherein said at least one rotatable member includes a cylindrical member having a plurality of circumferentially spaced ribs for discharging the treatment material.

56. The machine of claim 54 wherein said granular dispensing means comprises an internal chamber for receiving and holding a treatment material and a rotatable broadcasting means.

57. The machine of claim 56 wherein said rotatable broadcasting means includes at least one rotatable member for receiving and distributing the treatment material.

58. The machine of claim 57 wherein said at least one rotatable member includes a rotatable plate spaced from and vertically aligned with said discharge opening for receiving the treatment material that passes through said discharge opening.

59. The machine of claim 54 wherein said granular dispensing means includes a hopper, said hopper comprising a discharge opening through which the granular material exits said hopper.

60. The machine of claim 59 further comprising an agitator positioned within said hopper for contacting and agitating the treatment material.

61. The machine of claim 54 further comprising a control system for controlling the amount of treatment material provided to the area.

62. The machine of claim 54 further comprising a flow control system for controlling the flow rate of the treatment material provided to the area.

63. The machine of claim 44, wherein said machine may be used to remove snow from sidewalks and driveways.

64. A walk-behind snow removal machine comprising:

a housing including a forward opening through which snow enters the snow removal machine;

at least one rotatable member positioned within said housing for engaging and eliminating the snow from within said housing; and a liquid treatment material dispensing system including at least one spray nozzle connected to the housing for dispensing a liquid deicer and/or anti-icing treatment material over an area; and a heat transfer system associated with the dispensing system so as to maintain the liquid treatment material in a temperature range prior to dispensing over the area.

65. The machine of claim 64, further comprising a reservoir for carrying said liquid treatment material, and a conduit extending between said reservoir and said at least one spray nozzle for delivering the treatment material from the reservoir to the at least one spray nozzle.

66. The machine of claim 64, wherein said at least-one spray nozzle includes a plurality of spray nozzles spaced from each other along a surface of said housing.

67. The machine of claim 66, further comprising a spray bar extending along a length of said housing, said spray bar carrying said nozzles and securing said nozzles to said housing.

68. The machine of claim 64 further including pressure control system for controlling and varying the flow rate of the liquid treatment material provided to the area.

* * * * *